US007938233B2

(12) United States Patent
Kunz

(10) Patent No.: US 7,938,233 B2
(45) Date of Patent: May 10, 2011

(54) SYSTEM AND METHOD FOR DETECTING THE STATE OF AN ELEVATOR CAGE

(75) Inventor: René Kunz, Tokyo (JP)

(73) Assignee: Inventio AG, Hergiswil (CH)

( * ) Notice: Subject to any disclaimer, the term of this patent is extended or adjusted under 35 U.S.C. 154(b) by 750 days.

(21) Appl. No.: 11/887,034

(22) PCT Filed: Mar. 20, 2006

(86) PCT No.: PCT/CH2006/000167

§ 371 (c)(1),
(2), (4) Date: Oct. 29, 2007

(87) PCT Pub. No.: WO2006/099770

PCT Pub. Date: Sep. 28, 2006

(65) Prior Publication Data

US 2008/0283343 A1 Nov. 20, 2008

(30) Foreign Application Priority Data

Mar. 22, 2005 (EP) ..... 05102308

(51) Int. Cl.
*B66B 3/02* (2006.01)

(52) U.S. Cl. ..... 187/394; 73/158

(58) Field of Classification Search ..... 187/281, 187/391–394, 414; 73/158, 862.391, 862.392, 73/862.41, 862.453, 862.473; 324/522, 523, 525, 527, 543, 539, 237, 238
See application file for complete search history.

(56) References Cited

U.S. PATENT DOCUMENTS

| | | | | |
|---|---|---|---|---|
| 4,218,671 | A * | 8/1980 | Lewis | 187/394 |
| 4,427,095 | A | 1/1984 | Payne et al. | |
| 5,798,490 | A * | 8/1998 | Vairio et al. | 187/394 |
| 5,925,859 | A * | 7/1999 | Miller et al. | 187/394 |
| 6,454,054 | B1 * | 9/2002 | Tanino et al. | 187/394 |
| 6,651,781 | B2 * | 11/2003 | Lindegger et al. | 187/394 |
| 7,117,981 | B2 * | 10/2006 | Logan et al. | 187/391 |
| 2004/0174161 | A1 * | 9/2004 | Tausch et al. | 324/207.22 |
| 2006/0118364 | A1 * | 6/2006 | Birrer et al. | 187/394 |
| 2008/0087502 | A1 * | 4/2008 | Zapf | 187/394 |

FOREIGN PATENT DOCUMENTS

WO WO 2004/106209 12/2004

* cited by examiner

*Primary Examiner* — Jonathan Salata
(74) *Attorney, Agent, or Firm* — Wolff & Samson, PC

(57) ABSTRACT

An elevator system includes a lift cage, which is provided with a belt having markings disposed along the length thereof. A device for detecting at least the position, optionally, also the speed and the acceleration of the elevator cage, which is used to scan the markings, comprises a detector which is secured to the elevator cage and is displaced therewith. The detector is, preferably, arranged in such a manner that it detects the markings in one section of the belt which extend from the underloop of the carrier rollers on the elevator cage directly to a fixed point of the belt.

19 Claims, 3 Drawing Sheets

SYSTEM AND METHOD FOR DETECTING THE STATE OF AN ELEVATOR CAGE

This is a U.S. national stage of application No. PCT/CH2006/000167, filed on Mar. 20, 2006. Priority is claimed on that application and on the following application:

Country: Europe, Application No.: 05102308.3 Filed: Mar. 22, 2005.

BACKGROUND OF THE INVENTION

The invention relates to a method for detecting the state of an elevator cage and to an elevator system in which the method is used.

Means are usually present in elevator installations which make it possible to detect the instantaneous position and/or the speed and/or the acceleration of an elevator cage.

There are approaches in which, for example, markings or the like are provided at a guide rail in the elevator shaft and can be scanned from the elevator cage. Other elevator systems have a special elongate apertured strip which is mounted near the elevator cage in the elevator shaft and can be scanned by the elevator cage.

Moreover, it has already been proposed to provide a supporting/drive means (support cable, support belt) with markings and to scan these markings. An example can be inferred from the patent publication WO 2004/106209 A. According to this publication a detector is disposed at a fixed reference point in the shaft, while the supporting/drive means with the markings runs past the detector. In order to avoid problems with oscillations of the supporting/drive means, the detector is fixed in the region of the drive pulley of the drive unit.

The above-described solution has the disadvantage that it comprises a detector mounted in the region of the drive unit of an elevator without an engine room. On the one hand this detector is poorly accessible for elimination of faults and/or for maintenance operations and on the other hand interference fields, which impair the functional reliability of the detector, are present in the region of a modern drive unit supplied by a frequency converter.

SUMMARY OF THE INVENTION

The object of the invention is therefore to propose a method and an elevator system of the kind stated in the introduction which do not have the described disadvantages.

It is a further object of the invention to provide a method for detecting the state of the elevator cage, which is usable in the most diverse elevator systems with different reeving relationships.

According to the present invention the object is fulfilled by a method for detecting the state of an elevator cage or an elevator system in which, with the help of at least one detector, markings are detected at a belt-like supporting/drive means, wherein the belt-like supporting/drive means moves, during travel of the elevator cage, relative thereto. According to the invention the detector moves together with the elevator cage, wherein the belt-like supporting/drive means, which supports or moves the elevator cage, runs past the detector.

The detection of the state of the elevator cage includes detection of at least one of the following states: the position of the elevator cage in the lift elevator shaft, the travel direction, the instantaneous travel speed, and the acceleration. The mentioned states of the elevator cage are determined by the equipment according to the invention independently of any slip in the transmission of force between a drive pulley of a drive unit and the supporting/drive means.

The method according to the invention and the elevator system according to the invention have the advantage that a means present in any case in the elevator shaft, i.e. the belt-like supporting/drive means, can be used for the state detection of the elevator cage. The detector moving with the elevator cage is readily reachable for elimination of fault and/or for maintenance from, depending on its respective location of the elevator cage, the roof of the elevator cage or a shaft pit. Moreover, in this manner it is located outside a region in which interference fields of a frequency converter or a drive unit supplied by a frequency converter can impair the functionality reliability of the detector.

Advantageously the markings on the belt-like supporting/drive means are so constructed that the instantaneous position and/or the instantaneous speed and/or the acceleration of the elevator cage is recognisable by scanning the markings. This has the advantage that no additional installations have to be undertaken in the elevator shaft for determination of the position and/or the speed of the elevator cage. The costs of assembly and maintenance can thereby be kept low.

In a particularly preferred embodiment of the elevator system according to the invention the belt-like supporting/drive means supporting the elevator cage has multiple reeving (for example, 2:1, 3:1, 4:1 suspension) and the detector scans the markings of a section of the supporting/drive means which leads from the region of a support roller underlooping at the elevator cage directly to a fixing point of the supporting/drive means. It is thus achieved, firstly, that for every reeving ratio of the cage suspension the path by which the detector displaces relative to the markings at the supporting/drive means corresponds with the travel path of the elevator cage. The same device for detection of the state of the elevator cage—i.e. the same markings (or the same coding), the same detector and the same evaluating equipment—can therefore be used with all reeving ratios. Secondly, in this manner the markings are scanned in a region of the supporting/drive means which has the smallest possible spacing from a fixing point of the supporting/drive means and which during operation of the elevator runs least frequently over a support roller or the drive pulley of the drive unit and therefore retains for the longest period of time its original length and its stretch characteristics. Both features contribute to improvement of the accuracy and the reproducibility of the detection of the position of the elevator cage.

Advantageously consideration is given to the fact that the length of the belt-like supporting/drive means can change due to the instantaneous loading of the elevator cage. Compensation for this length change (extension) can be provided in the state detection. For example, the extension of the supporting/drive means can be determined by way of a computing process dependent on rated load and compensation for the influence thereof on the state detection can be provided in computerised manner. In addition, the extension, which is due to ageing, and/or a length change, which is due to temperature, of the belt-like supporting/drive means can be taken into consideration (compensated) in the state detection in that the information of a signal transmitter, which is preferably fixedly installed in the region of the ground floor, is included in the compensation calculation, which transmitter signals the exact position of the elevator cage on each occasion it moves past.

Advantageously the belt-like supporting/drive means is moved past the detector in the region of a support roller underlooping of the elevator cage so that a precisely defined scanning spacing (effective spacing), for example a spacing of less than 20 millimeters, between the belt rear side and the detector is guaranteed. With the arrangement of the detector in the region of a support roller underlooping, disturbing influences, which are caused by oscillating supporting/drive means, on the state detection are significantly reduced, so that the markings can be accurately scanned by the detector at the smallest possible scanning spacing. Denoted as support roller underlooping at the elevator cage is equipment which is mounted on the elevator cage below or above this and which comprises one or two support rollers around which the supporting/drive means is guided in order to support and move the elevator cage. A corresponding number of such support roller underloopings is present at the lift elevator cage supporting/drive means with multiple reeving.

According to an advantageous embodiment of the invention the belt-like supporting/drive means has a belt front side and a belt rear side, wherein the belt rear side has the markings and does not come into contact with the drive rollers or support rollers of the elevator system. The belt-like supporting/drive means is so guided that always only the belt front side comes into contact with the rollers. The markings applied to the belt rear side are not prejudiced during the transmission of force between the drive pulley of the drive unit and the supporting/drive means as well as during rotation of the support rollers, i.e. mechanical abrasion or mechanical loading as well as contamination of the markings are thus minimised.

Advantageously use is made as belt-like supporting/drive means of a cogged belt with a series of teeth on the belt front side, a wedge-ribbed belt with V-shaped ribs on the belt front side, a flat band, a flat belt, a double rope or another supporting or drive means, which has two belt main surfaces. Such belt-like supporting/drive means have the advantage that the two belt main surfaces can be of different form. Thus, for example, the front side of the belt-like supporting/drive means, which serves as contact surface with respect to the drive rollers or elevator rollers, can have a means for increasing traction capability or for guidance of the belt-like supporting/drive means on the drive pulley or on the supporting or deflecting rollers.

Advantageously optical markings are applied to the belt-like supporting/drive means and are scanned by an optical detector, for example a reflection detector. The markings are in that case applied to the belt-like supporting/drive means at the surface. This has the advantage that the strength of the belt-like supporting/drive means is not impaired. In addition, visible markings offer a number of economic possibilities for coding data or positions.

In other advantageous embodiments, magnetic markings are applied to the belt-like supporting/drive means and scanned by a magnetic detector. The markings can in that case be applied not only to the surface, but also in the interior of the belt-like supporting/drive means. A magnetic scanning system has the advantage that contaminations, for example due to dust or oil, do not cause disturbances. In addition, the magnetic markings can be applied below the surface and thus protected against mechanical loads.

Particularly reliable elevator controls can be realised if the markings form a coding which enables direct detection of the absolute position of the elevator cage. By comparison with an incremental travel and position detection, a travel and position detection by means of absolute coded markings is less susceptible to fault. It is particularly advantageous that an absolute travel and position detection does not lose the information about the instantaneous position of the elevator cage in the event of power failure. Data about the instantaneous speed and optionally the acceleration are derived by the control from the position information which is present.

If required, the belt-like supporting/drive means is turned between the drive pulley of the drive unit and the first support roller at the elevator cage, optionally also between further support rollers along the longitudinal axis thereof, so as to achieve that the surface, which is provided with the markings, of the supporting/drive means (here termed belt rear side) always faces away from the pulleys and rollers during rotation thereof. It is thus achieved that the markings are not destroyed as a consequence of abrasion or other mechanical loads.

BRIEF DESCRIPTION OF THE DRAWINGS

Further details and advantages of the invention are described in the following on the basis of examples and with reference to the drawing, in which.

DETAILED DESCRIPTION OF THE INVENTION

Before different forms of embodiment of the invention are described, there initially follows some basic definitions of terms.

The invention relates to specific elevator systems in which at least one belt with a driving and/or supporting function is used, which is driven by means of a drive unit, usually by way of a drive pulley, and moves and/or supports the elevator cage. Such a belt is generally termed belt-like supporting/drive means in the following.

The belt-like supporting/drive means is an elongate flexible element with two substantially parallel belt main surfaces and two belt side surfaces (edges). One of the belt main surfaces is preferably, but not necessarily, structured. This belt main surface is termed belt front side in the following. The structuring serves for lateral guidance of the supporting/drive means on the pulleys and rollers and/or for increasing traction capability. The structure can, for example, consist of parallel belt ribs, between which belt grooves are formed. The belt grooves and belt ribs can extend transversely to the belt longitudinal axis (in this case the belt can be termed cogged belt) or parallel to the belt longitudinal axis (in this case the belt can be termed, for example, wedge-ribbed belt). The belt-like supporting/drive means can comprise a belt body of rubber or synthetic material, in which at least one synthetic material cable or steel cable is embedded as tension means.

The second belt main surface is termed belt rear side in the following. Preferably, the belt rear surface is an unstructured side of the belt. According to the invention markings are applied to or on this belt rear side and are scanned by means of a detector in order to obtain information about the current position or the speed of the elevator cage, as is explained in more detail in the following by way of different forms of embodiment.

Figure 1:
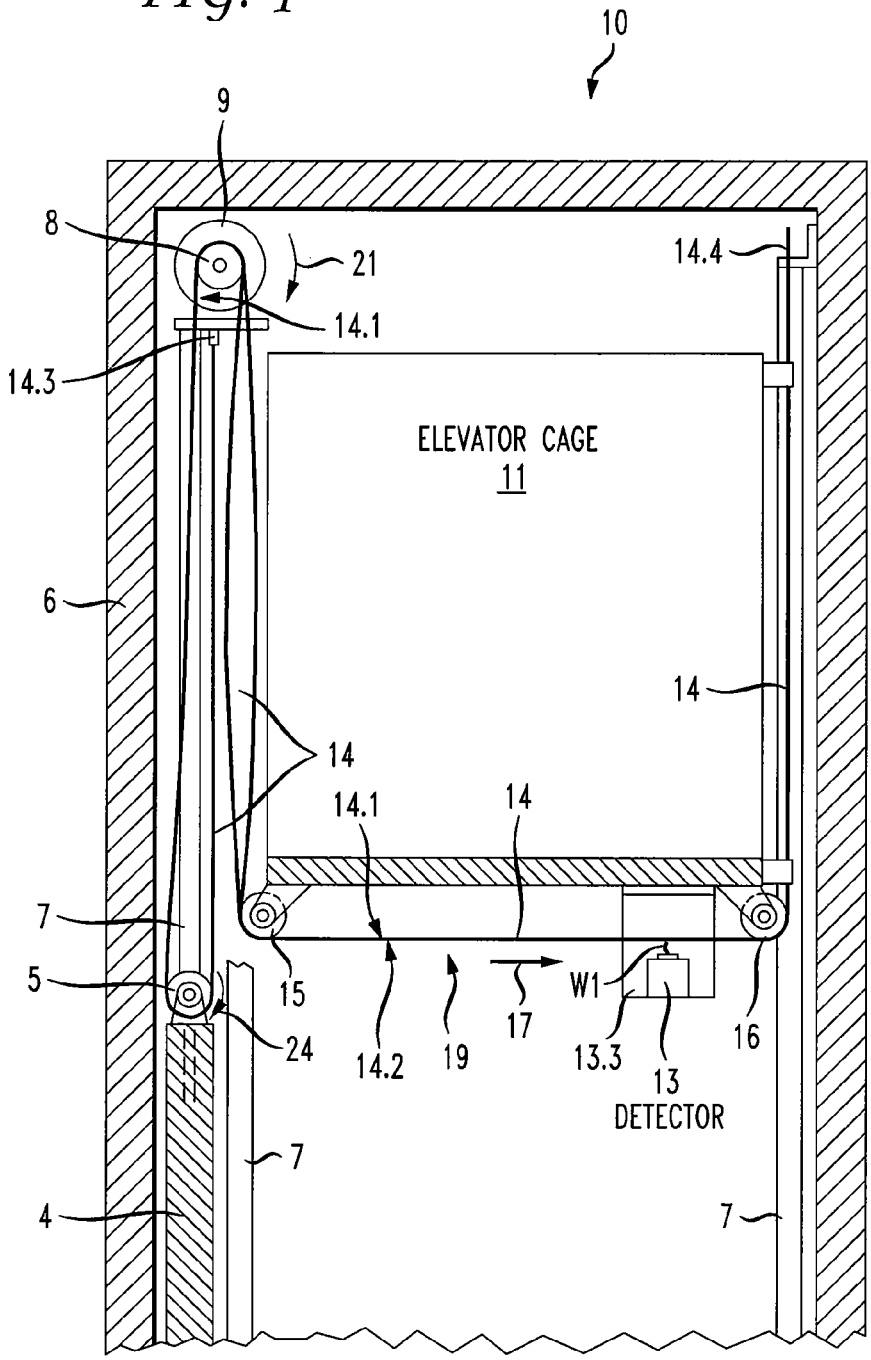
FIG. 1 shows an elevator system according to the invention, in simplified illustration.

FIG. 1 shows an elevator system 10 according to the invention with a belt-like supporting/drive means 14. The belt-like supporting/drive means 14 is coupled in terms of motion with different elements of the elevator system. The essential elements of the elevator system 10 are explained in the following insofar as they are necessary for an understanding of the invention.

An elevator shaft 6, an elevator cage 11 and a counterweight 4, which are guided at guide rails 7, a drive unit 9 with a drive pulley 8, the belt-like supporting/drive means 14, a first support roller 15 and a second support roller 16, which parts form a support roller underlooping 19, which is present at the elevator cage, for the supporting/drive means 14, as well as a counterweight support roller 5 are illustrated. The supporting/drive means 14 is connected at a first fixed point 14.3 with a first vertical guide rail 7, subsequently runs around the counterweight support roller 5, around the drive pulley 8, around the support roller underlooping 19 and to a second fixing point 14.4 in the region of the upper end of a second vertical guide rail 7. The supporting/drive means 14 has double reeving, i.e. it forms a 2:1 suspension for the elevator cage 11 and the counterweight 4. The belt-like supporting/drive means is turned through approximately 180° about its longitudinal axis between the drive pulley 8 and the support roller 15, whereas it is not turned between the support roller 15 and the support roller 16. It is achieved by the turning that the (usually structured) belt front side 14.1 always stands in contact with the circumferential surfaces of the drive pulley 8 and the support rollers 15 and 16.

In the embodiment, which is shown in FIG. 1, of the invention a detector 13 is mounted below the floor of the lift cage 11. Since in the illustrated constellation the belt rear side 14.2 of the supporting/drive means 14 faces downwardly, the detector 13 is fastened below the supporting/drive means 14. For this purpose, in the illustrated example there is mounted at the floor of the elevator cage a U-shaped bracket 13.3 which carries the detector 13 and forms a cut-out through which the supporting/drive means 14 is guided in the region of the support roller underlooping 19. During travel of the elevator cage the supporting/drive means moves in this region horizontally in the direction of the arrow 17, wherein its movement relative to the elevator cage corresponds with respect to travel, speed and acceleration with the vertical movement of the elevator cage. Through scanning of the markings on the belt rear side the detector supplies data to a control which ascertains therefrom the position, speed and optionally acceleration of the elevator cage. The detection of the markings takes place in a section of the supporting/drive means 14 which leads from the region of the support roller underlooping 19 directly to the fixing point 14.4 of the supporting/drive means.

It is also conceivable to mount the belt-like supporting/drive means 14 without a twist of 180° along the longitudinal axis between the drive pulley 8 and the support roller 15. The belt rear side, which has the markings, of the belt-like supporting/drive means 14 would thereby be contacted by the support rollers 15, 16. Although these do not exert traction forces on the belt-like supporting/drive means 14, the markings would be subjected to additional mechanical loads and contaminations.

Suitable rubbers and elastomers (synthetic materials), particularly polyurethane (PU) and ethylenepropylene copolymer (EPDM), come into question as material for a belt 14 which has a structured belt front side 14.1 and is suitable for use in an elevator system 10. In a given case the belt 14 can be furnished with reinforcing inlays oriented in longitudinal direction of the belt and/or reticular reinforcing inlays. Twisted steel wire strands, for example, are suitable as reinforcing inlays oriented in longitudinal direction of the belt.

Figure 2:
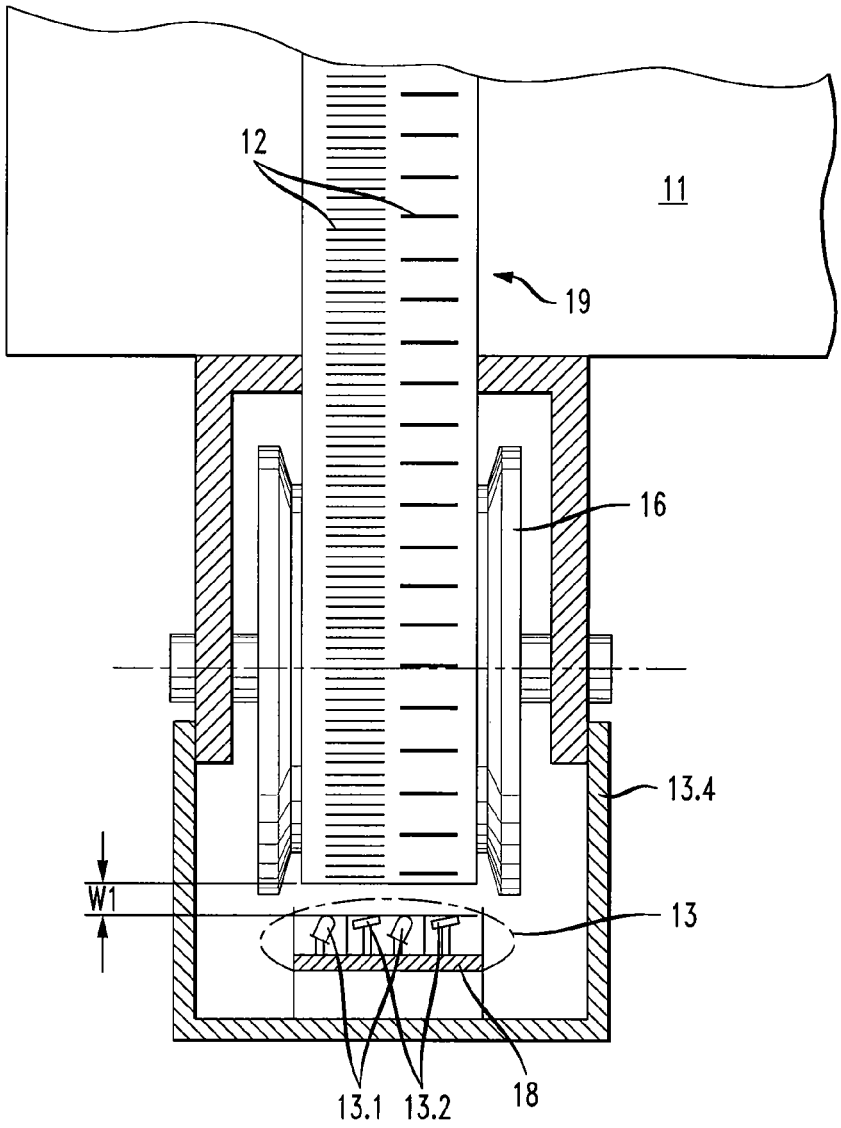
FIG. 2 shows a detailed view of an elevator roller below the lift elevator cage with a belt and two markings, in simplified illustration.

FIG. 2 shows a possible embodiment of the invention with a belt-like supporting/drive means 14, on the rear side 14.2 of which optical markings 12 are present on two parallel marking tracks. In this embodiment the detector 13 is seated in the region of a support roller 16 of a support roller underlooping 19 mounted at the elevator cage 11. Such an arrangement is particularly suitable for elevator cages in which each support roller underlooping comprises a single support roller, for example in the case of a 'rucksack' cage or in the case of a support roller underlooping arranged above the cage roof. A U-shaped bracket 13.4, which is mechanically connected with the axle of the support roller 15, is provided. Through the use of a supporting/drive means with more than one marking track 12 the vertical position of the elevator cage 11 in the elevator system 10 can be more accurately determined in that, for example, one marking track has an absolute value coding with relatively fine resolution and the other marking track supplies signals with high travel resolution for interpolation between the absolute values of the first track.

It is also possible to so code a marking track or several marking tracks that this enables or these enable direct detection of absolute position values with sufficient resolution. Examples of such codings are the multi-track Gray code or a known single-track coding in which several successive code marks of different magnetic polarity or with different reflection characteristics each form a respective code word corresponding with a defined position. A large number of such code words are arranged with binary pseudo random coding in a row as a code mark pattern, wherein each code word represents an absolute cage position. Detectors which each comprise several parallelly or serially arranged sensors for detection of the markings are required for scanning a Gray coding or a binary pseudo random coding. The described forms of the marking can be used together with suitable elevator controls for coarse and fine positioning in order, for example, to be able to move very accurately to storeys. Advantageously the markings 12 are composed of bars and/or stripes which are arranged at right angles to the longitudinal axis of the supporting/drive means and which are applied in strongly contrasting manner, advantageously with bright color to a dark belt-like supporting/drive means 14, or vice versa.

The optical markings 12 are scanned by an optical detector 13, advantageously by a reflection detector 13. The detector 13 comprises an LED 13.1 and a light-sensitive semiconductor 13.2 (for example, a photodetector). LED 13.1 and light-sensitive semiconductor 13.2 can also be combined in one element. The detector 13 is mounted at an effective spacing W1 from the belt rear side 14.2. Advantageously it is mounted on a circuitboard 18 and is controlled in drive and evaluated by additional electronic components via conductive connections. The detector 13 can issue the light beam, the frequency of which should not be located in the visible range, at a desired angle between 90 and 45° relative to the belt rear side 14.2 and receive it at the same angle.

It is also possible to, for example, apply a magnetic marking to the belt-like supporting/drive means 14 instead of or additionally to the optical marking 12. In the case of a marking of that kind it is similarly possible to apply several tracks adjacent to one another to the belt-like supporting/drive means 14. The corresponding magnetic detector 13 reads the magnetic characteristics of the individual tracks, from which the precise vertical position and/or the speed of the elevator cage 11 can be determined.

Figure 3:
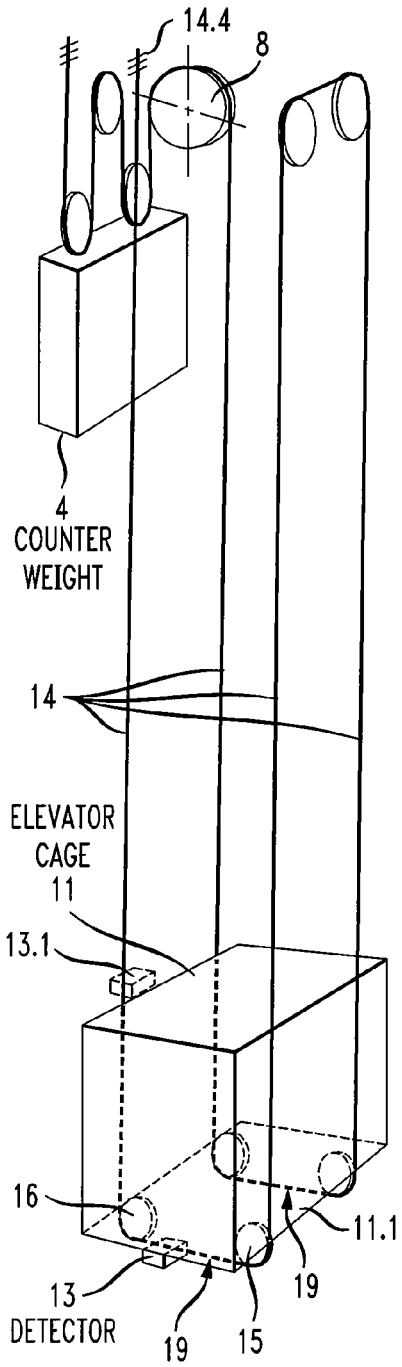
FIG. 3 shows an elevator installation according to the invention with quadruple reeving of the supporting/drive means (4:1 suspension of the elevator cage) and two supporting roller underloopings arranged above the elevator cage
Figure 4:
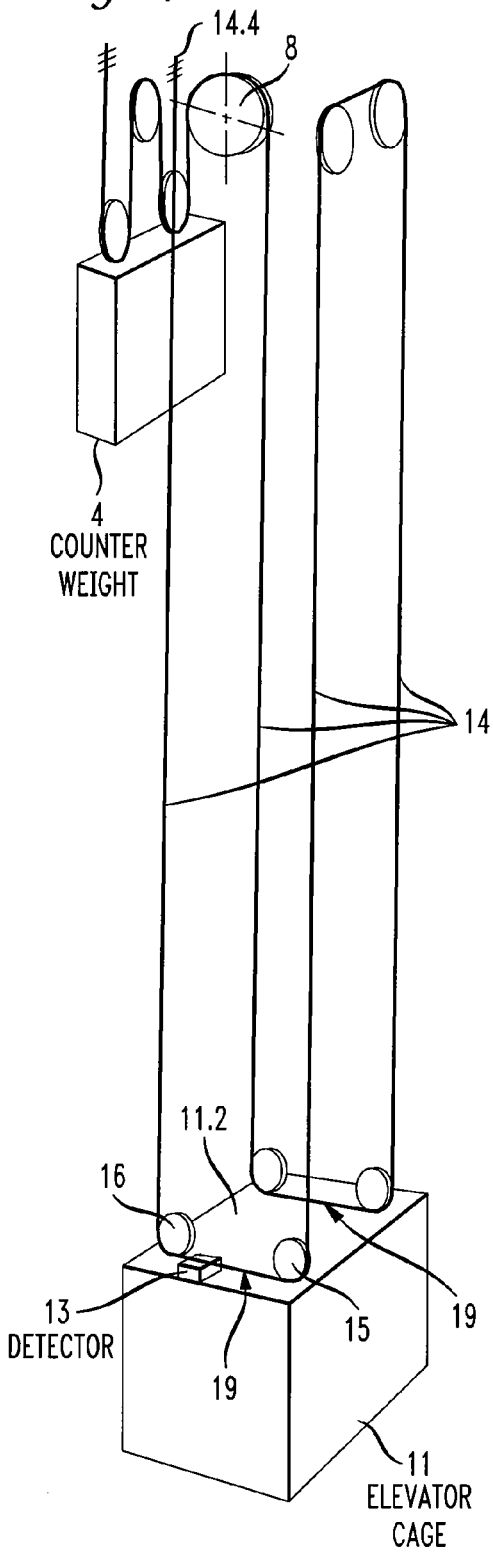
FIG. 4 shows an elevator installation according to the invention with quadruple reeving of the supporting/drive means (4:1 suspension of the elevator cage) and two supporting roller underloopings arranged below the elevator cage.

FIGS. 3 and 4 schematically show elevator systems according to the invention with in each instance an elevator cage 11 and a counterweight 4, a drive pulley 8 as well as a quadruply reeved supporting/drive means 14 with the required deflecting rollers in known arrangement (4:1 suspensions for the elevator cage and also for the counterweight). Two support rollers underloopings 19 each with two support rollers 15, 16 are mounted at the elevator cage 11, which is illustrated in FIG. 3, below the cage floor 11.1. By contrast thereto, two cage roller underloopings 19 each with two support rollers 15, 16 are fastened to the elevator cage 11, which is illustrated in FIG. 4, above the cage roof 11.2.

In the two elevator systems shown in FIGS. 3 and 4 the elevator cages are suspended in each instance at two cable loops of a supporting/drive means 14, wherein each of the cable loops underloops two support rollers 15, 16 each of one of the two support roller underloopings 19. The travel or the speed of the section (run), which runs over the drive pulley 8, of the supporting/drive means 14 in that case corresponds with four times the travel and the speed, respectively, of the moving elevator cage. In order to ensure that the belt rear side provided with the markings does not come into contact either with the circumferential surface of the drive pulley 8 or with that of the support rollers of the support roller underloopings 19 the belt-like supporting/drive means 14 is also here turned through 180° about its longitudinal axis in the region of its section (run) lying between the drive pulley 8 and the first support roller at the elevator cage (not illustrated in FIGS. 3 and 4).

Detectors which, as described in the foregoing, in the region of a respective one of the support roller underloopings at the elevator cage scan markings on the belt rear side of the supporting/drive means 14 are illustrated by 13 in FIG. 3 and also in FIG. 4. The scanning here also takes place at a section (run) of the supporting/drive means which runs from the region of a support roller underlooping directly to a fixing point 14.4 of the supporting/drive means 14, wherein the stated section moves past the elevator cage 11 by a travel path or at a speed which respectively corresponds with the travel path or the travel speed of the elevator cage.

The detector could also, as illustrated in FIG. 3 by dot-dashed lines 13.1, be oriented directly onto the vertical section, which leads to the fixing point 14.4 at the cage side, of the supporting/drive means 14. This arrangement is subject to the disadvantage that transverse oscillations occur with greater probability in this region of the supporting/drive means. However, this problem would be able to be eliminated by an additional guidance of the supporting/drive means.

It can be readily seen that the described principle of arrangement is usable for all elevator systems in which, during travel, a run of the supporting/drive means moves past the elevator cage, wherein the following advantages, which were already mentioned in the description of advantage, are always achieved:

- good accessibility to the detector for elimination of faults and for maintenance,
- location of the detector away from interference fields of a drive unit supplied by a frequency converter,
- the same device for detection of the state of the elevator cage is always usable regardless of the reeving ratio and
- highest possible accuracy of the positional detection by scanning of the markings at a section of the supporting/drive means which leads directly to a fixing point.

The detection of the vertical position of the elevator cage 11 in the elevator system 10 is falsified by an operationally induced change in the length of the belt-like supporting/drive means 14, which can occur due to the most diverse external influences. Compensation can be made for such falsifications by measurement of such influencing factors. Thus, for example, the weight of the elevator cage 11, which changes as a consequence of different loading, can be detected by a sensor and compensation for the influence of the cage weight can be provided in the elevator control by appropriate software. Such a sensor can, for example, be a strain gauge mounted in the region of a fixing point of the supporting/drive means.

Further environmental influences such as, for example, ageing and a stretching, which is connected therewith, of the belt-like supporting/drive means 14 or temperature-dependent expansion can be similarly detected by suitable means and compensation can be provided with the help of the elevator control. For preference use is made for this purpose of a position transmitter fastened in the elevator shaft in fixed position.

Obviously, more than one belt-like supporting/drive means can be arranged parallel to one another in realised elevator systems. In that case either only a respective one or, for example, two of the supporting/drive means can be provided with markings. In the second case a second detector can, for the purpose of increase in operational reliability, supply a redundant position and/or speed signal.

The invention claimed is:

1. A method for detecting a state of an elevator cage which is supported and moved by a belt, wherein the belt has, along its length, markings which are scanned by a detector of a device for detecting the state of the elevator cage, the method comprising the steps of:

moving the detector together with the elevator cage; and running the belt past the detector and scanning the markings with the detector.

2. The method according to claim 1, wherein the markings are constructed so that an instantaneous position and/or instantaneous speed and/or acceleration of the elevator cage can be detected by the scanning of the markings.

3. The method according to claim 1, wherein the belt carrying the elevator cage has multiple reeving and the markings, the method including scanning the markings by the detector at a section of the belt which is led from a region of a support roller underlooping at the elevator cage directly to a fixing point of the belt.

4. The method according to claim 1, including taking into consideration for detecting the state of the elevator cage, an extension of the belt which is caused by a varying total weight of the elevator cage.

5. The method according to claim 1, including taking into consideration for detecting the state of the elevator cage, an extension of the belt which is caused by stretching, ageing and/or temperature changes.

6. An elevator system, comprising: an elevator cage; a belt having markings along its length; and a device for detecting a state of the elevator cage, wherein the detecting device includes a detector for scanning the markings, wherein he detector is arranged to move together with the elevator cage and so that the belt runs past the detector, wherein the detector scans the markings.

7. The elevator system according to claim 6, wherein the belt carries the elevator cage and has multiple reeving, the markings being scanned by the detector at a section of the belt which is led from a region of a support roller underlooping at the elevator cage directly to a fixing point of the belt.

8. The elevator system according to claim 6, wherein the belt runs through a support roller underlooping in a floor region or a roof region of the elevator cage and the detector is mounted in a region between two support rollers of the support roller underlooping.

9. The elevator system according to claim 6, wherein the belt runs through a support roller underlooping at the elevator cage so that a belt rear side runs past the detector at a defined effective spacing.

10. The system according to claim 6, wherein the belt has a belt front side and a belt rear side, wherein the belt rear side has the markings and does not come into contact with drive rollers, support rollers or defecting rollers of the elevator system.

11. The elevator system according to claim 6, wherein the belt is a cogged belt with a row of teeth on a belt front side.

12. The elevator system according to claim 6, wherein the belt is a wedge-ribbed belt with ribs on a belt front side.

13. The elevator system according to claim 6, wherein the belt is a flat band.

14. The elevator system according to claim 6, wherein the belt is a flat belt.

15. The elevator system according to claim 6, wherein the markings are optically scannable and the detector is an optical detector.

16. The elevator system according to claim 15, wherein the detector is a reflection detector.

17. The elevator system according to claim 6, wherein the markings are magnetically scannable and the detector is a magnetic detector.

18. The elevator system according to claim 6, wherein the markings form a coding which enables direct detection of an absolute position of the elevator cage.

19. The elevator system according to claim 6, wherein the markings are on a belt rear side of the belt, and further comprising two adjacent pulleys or rollers, wherein a section of the belt extends between the two adjacent pulleys or rollers and is turned about a longitudinal axis of the section so as to enable the belt rear side of the belt to not come into contact with circumferential surfaces of the pulleys and rollers.

* * * * *